US008194904B2

(12) United States Patent
Iwayama

(10) Patent No.: US 8,194,904 B2
(45) Date of Patent: Jun. 5, 2012

(54) SPEAKER SYSTEM WITH BROAD DIRECTIVITY

(75) Inventor: Ken Iwayama, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 1483 days.

(21) Appl. No.: 11/707,777

(22) Filed: Feb. 15, 2007

(65) Prior Publication Data

US 2007/0199766 A1 Aug. 30, 2007

(30) Foreign Application Priority Data

Feb. 28, 2006 (JP) ..... 2006-052910

(51) Int. Cl.
*H04R 1/20* (2006.01)

(52) U.S. Cl. ..... 381/342; 181/144; 181/177; 381/182; 381/340; 381/386; 381/337; 381/338; 381/339; 381/343

(58) Field of Classification Search ..... 381/340, 381/343
See application file for complete search history.

(56) References Cited

U.S. PATENT DOCUMENTS

| | | | | |
|---|---|---|---|---|
| 1,486,659 | A | 3/1924 | Foley | |
| 2,563,948 | A | 8/1951 | Lowell | |
| 2,819,773 | A | 1/1958 | Lowell | |
| 4,157,741 | A | 6/1979 | Goldwater | |
| 4,554,414 | A | 11/1985 | House | |
| 4,837,839 | A * | 6/1989 | Andrews | 381/182 |
| 5,629,501 | A | 5/1997 | Fenton | |
| 6,222,929 | B1 * | 4/2001 | Kim | 381/182 |
| 6,950,530 | B2 * | 9/2005 | Baird et al. | 381/343 |
| 2006/0159299 | A1 | 7/2006 | Iwayama et al. | |
| 2006/0233402 | A1 * | 10/2006 | Inagaki et al. | 381/182 |

FOREIGN PATENT DOCUMENTS

| | | | |
|---|---|---|---|
| EP | 1 333 698 | A | 8/2003 |
| JP | 60-167494 | A | 11/1985 |
| JP | 61-104696 | A | 7/1986 |
| JP | 02-120976 | A | 10/1990 |
| JP | 11-098591 | A | 4/1999 |
| JP | 2004-193749 | | 7/2004 |
| JP | 2005-277616 | A | 10/2005 |

OTHER PUBLICATIONS

Notification of Reasons for Rejection mailed Mar. 8, 2011, for JP Patent Application No. 2006-052910, with English Translation, six pages.

* cited by examiner

*Primary Examiner* — Brian Ensey
*Assistant Examiner* — Taunya McCarty
(74) *Attorney, Agent, or Firm* — Morrison & Foerster LLP

(57) ABSTRACT

Disclosed herein is a speaker system unit with a cone type vibration plate, a horn and a diffuser. The horn is disposed such that a small-diameter opening thereof is positioned inward from a front opening of the vibration plate, and an outer surface of the horn is arranged along an inner surface of the vibration plate to form a first acoustic path. The diffuser has a base portion, a front end portion and an outer peripheral surface extending therebetween, and is disposed such that the base portion is positioned inward from a front opening of the horn, opposite the small-diameter opening of the horn. The diffuser has a specific shape such that the outer peripheral surface expands along an inner surface of the horn to form a second acoustic path and then narrows toward the front end portion of the diffuser.

6 Claims, 5 Drawing Sheets

--PRIOR ART--

--PRIOR ART--

SPEAKER SYSTEM WITH BROAD DIRECTIVITY

BACKGROUND OF THE INVENTION

1. Technical Field of the Invention

The present invention relates to a speaker system with broad directivity which can achieve broad band directivity ranging from a low frequency to a relatively high frequency.

2. Description of the Related Art

In a speaker system mounted to a ceiling or the like, a cone type speaker is generally used in a unitary body. In order to increase electric-acoustic transducing efficiency, there may be a demand of desiring to use the cone type speaker with large diameter (over about 6.5 inch or 16.5 cm). However, as the diameter of the speaker is larger, a problem of directivity arises.

FIGS. 7(*a*) and 7(*b*) show a feature of a conventional cone type speaker with large diameter.

FIG. 7(*a*) is a graph showing a directivity when a conventional cone type speaker with large diameter is used. FIG. 7(*b*) is a graph showing a frequency response when a high frequency speaker is combined with a conventional cone type speaker with large diameter.

In FIG. 7(*a*), a sound pressure level at a position spaced apart (e.g., 1 m) from the cone type speaker with large diameter along a central axis (0°) of the speaker is set as a reference. When a frequency (f) of sound is in a low frequency range, there exists no directivity. But, in the range from a mid frequency to a high frequency, the sound pressure near the central axis is high, but the sound pressure in an oblique direction is decreased. Thus, when the cone type speaker with large diameter is mounted to a ceiling, the sound is clear right under the cone type speaker, but as being distant therefrom, the sound becomes hollow and unclear.

Thus, when the cone type speaker is used for call announcement or playing music, if it is needed to broaden the directivity for mid and high frequency, the cone type speaker with small diameter is used. However, the transducing efficiency is deteriorated.

Because an equivalent mass of the cone type speaker with large diameter is originally large, an emitting energy of high frequency is not generated. Thus, in order to output the high frequency sound, a high frequency speaker (tweeter) is commonly used together. Because a diameter of the high frequency speaker is small, the high frequency speaker originally has a broad directivity. And, because a size of the high frequency speaker is compact, plural high frequency speakers can be installed.

However, when the cone type speaker with large diameter is used as a woofer and the high frequency speaker is set to output the sound of high frequency higher than a crossover frequency, no problem occurs at the central axis (0°), but a sound pressure in the oblique direction is insufficient in a little lower range than the crossover frequency, as shown in FIG. 7(*b*). Thus, to combine the high frequency speaker only with the cone type speaker with large diameter has a defect that the broad directivity cannot be achieved with respect to the relatively high frequency sound rather than the low frequency sound.

As an example of a conventional speaker system using the cone type speaker, the speaker system in which a front surface of a cone type vibration plate is covered with a refining member is disclosed for example in Japanese Patent Laid-open Publication No. 2004-193749 and corresponding U.S. Pat. No. 4,554,414. The refining member includes a small diameter center hole and plural peripheral holes around the center hole. When emitting the high frequency sound, the sound pressure level in the front direction is decreased by interference due to phase difference between the sound radiated from the center hole and the sound radiated from the peripheral holes, thereby increasing the high frequency directivity. Also, a diffuser is mounted at the front of the center hole. The diffuser has a substantially conical shape at an upper-half portion, a substantially hemispheric shape at a lower-half portion, and an approximately same diameter as the center hole. Such a diffuser increases the directivity, especially, of high frequency.

As describe above, the conventional speaker system is configured such that a closed space is formed by the cone type vibration plate and the refining member, and the phase interference is generated by radiating the sound energy generated at the closed space from the center hole and the peripheral holes. However, because the closed space constitutes a low-pass filter, the output sound pressure level of high frequency has been decreased.

Further, because the phase interference is performed by using two acoustic paths, i.e., the center hole and the peripheral holes, a peak and a dip of the phase interference become steep.

SUMMARY OF THE INVENTION

Therefore, the present invention has been made in view of the above problems, and it is an object of the present invention to provide a speaker system with broad directivity which can achieve a broad directivity ranging from a low frequency to a relatively high frequency.

In order to solve the above problems, the present invention is characterized by a configuration described below.

In accordance with the present invention, the above and other objects can be accomplished by the provision of a speaker system with broad directivity using a speaker unit having a cone type vibration plate with a front opening. The speaker system comprises a first horn and a diffuser. The first horn has a small-diameter opening and is disposed such that the small-diameter opening is positioned inward from the front opening of the cone type vibration plate and an outer surface of the first horn is arranged along an inner surface of the cone type vibration plate from the small-diameter opening to form a first acoustic path between the outer surface of the first horn and the inner surface of the cone type vibration plate. The diffuser has a base portion, a front end portion and an outer peripheral surface extending therebetween, and is disposed such that the base portion is positioned inward from a front opening of the first horn and opposed to the small-diameter opening of the first horn, and the diffuser has a shape such that the outer peripheral surface expands along an inner surface of the first horn from the base portion to form a second acoustic path between the expanding outer peripheral surface of the diffuser and the inner surface of the first horn and such that the expanding outer peripheral surface of the diffuser is then narrowed toward the front end portion of the diffuser.

Accordingly, by the first horn and the diffuser, the phase of the sound is adjusted, and the broad directivity can be achieved with respect to the range from the low frequency to the relatively high frequency.

The first horn forms the first and second acoustic paths for guiding the sound along the inner surface and the outer surface of the cone type vibration plate. Therefore, unlike the prior art which confines the sound, because the decrease of the output sound pressure level with respect to the high frequency is small, the clearness of the sound can be increased without decrease of a cutoff frequency.

Preferably, the speaker system with broad directivity further comprises a second horn that is located adjacent to the front opening of the cone type vibration plate and expands in an extending direction of the cone type vibration plate, and that is disposed such that an inner surface of the second horn is arranged along the outer surface of the first horn to form a gap between the inner surface of the second horn and the outer surface of the first horn for extending the first acoustic path.

In general, it is unnecessary to transfer the sound in a direction approximately 90° from a central axis. Accordingly, by concentrating the sound emitted through the first acoustic path on a cover area within a desired angle from the central axis by means of the second horn, a sound transducing efficiency can be increased.

In another aspect of the invention, there is provided a speaker system with broad directivity using a speaker unit having a vibration plate of a non-cone type. The inventive speaker system comprises a first horn, a second horn and a diffuser. The second horn is disposed such that a small-diameter opening of the second horn is positioned at an opening of the speaker unit. The first horn is disposed such that a small-diameter opening of the first horn is positioned inward from a front opening of the second horn and that an outer surface of the first horn extends along an inner surface of the second horn from the small-diameter opening of the first horn to form a first acoustic path between the outer surface of the first horn and the inner surface of the second horn. The diffuser has a base portion, a front end portion and an outer peripheral surface extending therebetween, and is disposed such that the base portion is positioned inward from a front opening of the first horn and opposed to a small-diameter opening of the first horn, and the diffuser has a shape such that the outer peripheral surface of the diffuser expands along an inner surface of the first horn from the base portion to form a second acoustic path between the expanding outer peripheral surface of the diffuser and the inner surface of the first horn and such that the expanding outer peripheral surface of the diffuser is then narrowed toward the front end portion of the diffuser.

Since the second horn performs a function of the cone type vibration plate, even though the speaker unit has the non-cone type vibration plate, the inventive speaker system can achieve the same effect as the speaker system using the cone-type vibration plate.

Preferably, speaker system with broad directivity further comprises a plurality of high frequency speakers (tweeters) which are accommodated in the outer peripheral surface of the diffuser which is obliquely cut around the front end of the diffuser such that the plurality of the high frequency speakers are arranged radially around a central axis of the diffuser.

For reinforcing the high frequency sound output, which could not be achieved by the speaker unit having the cone type vibration plate alone, the broad directivity with respect to a full range can be achieved by use of the high frequency speakers. As a result, the clearness of the sound is increased.

Further, because the plural high frequency speakers are mounted radially in the oblique direction, the high frequency sound is not concentrated on the front of the diffuser. As a result, the broad directivity with respect to the high frequency is achieved. The number of the high frequency speakers may be two. In order to spread the sound more broadly, it is preferable to mount three or more high frequency speakers.

Preferably in the speaker system with broad directivity, the diffuser has a hole at a central portion, which forms a third acoustic path.

Accordingly, in addition to the first acoustic path and the second acoustic path, by adding the third acoustic path formed by the hole, the number of the acoustic paths generating path difference is increased, so that a peak and a dip generated at a specific frequency can be moderated by the phase interference.

In this manner, in accordance with the present invention, the broad directivity can be achieved with respect to the range from the low frequency to the relatively high frequency without causing the decrease of the output in the relatively high frequency range. Accordingly, the cone type speaker unit with large diameter can be improved so as to increase the transducing efficiency and simultaneously to achieve the broad directivity with respect to the relatively high frequency range.

Also, the speaker system of the present invention has a simple structure in which the high frequency speaker unit can be easily added or the third acoustic path can be easily formed.

Further, for example, when the speaker system of the present invention is mounted to a ceiling, since the transducing efficiency can be increased while maintaining the broad directivity, the installation number of the speakers can be reduced, or a low power amplifier can be used in the speaker system.

DETAILED DESCRIPTION OF THE INVENTION

Figure 1:
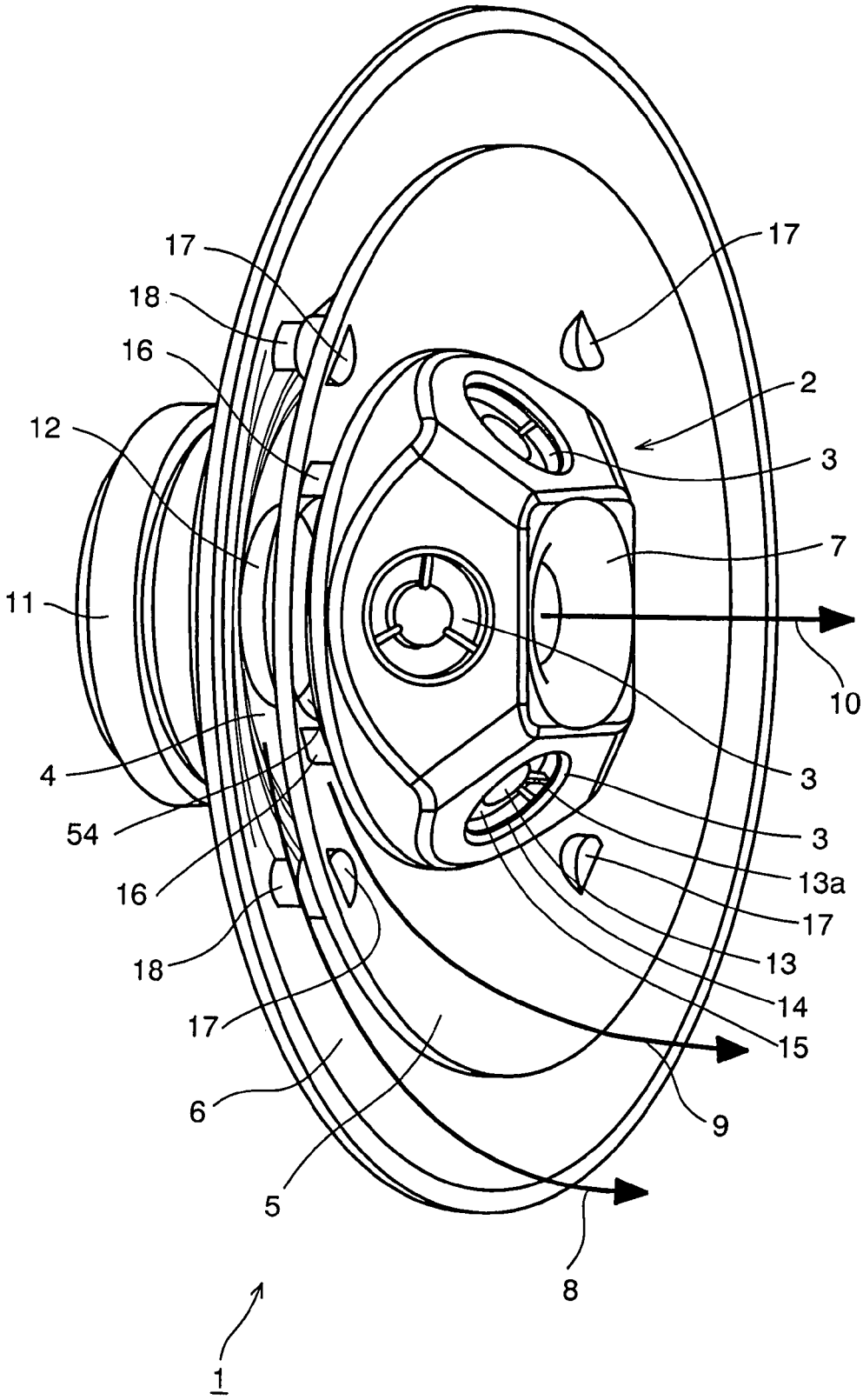
FIG. 1 is a perspective view showing a first embodiment of present invention.

FIG. 1 is a perspective view showing a first embodiment of the present invention.

A reference numeral 1 indicates a cone type speaker unit, which plays a role of outputting sound ranging from a low frequency to a relatively high frequency, i.e., corresponds to a "woofer". In order to increase a transducing efficiency, a diameter of the cone type speaker may be increased over 6.5 inch (16.5 cm). It is preferable that the diameter is about 8 inch (20.32 cm).

A reference numeral 2 is a diffuser. It is depicted in the drawing that high frequency speaker units 3 are mounted to an outer peripheral surface 57 (see FIG. 4) of the diffuser 2, however, this is not an indispensable structure. The high frequency speaker unit 3 plays a role of outputting high frequency sound, i.e., corresponds to a "tweeter". It is depicted in the drawing that four units are arranged equi-angularly with each other.

A reference numeral 4 is a cone type vibration plate of the speaker unit 1. A typical cross-sectional shape of the cone type vibration plate 4 is a straight line shape according to its own name of "cone", however, it may be formed in a curve shape such that a rate of widening is increased as it extends outward.

A first horn 5 is mounted between the cone type vibration plate 4 and the diffuser 2. A first acoustic path 8 is formed in a ring shape at a gap between the cone type vibration plate 4 and the first horn 5. A second acoustic path 9 is formed in a ring shape at a gap between the diffuser 2 and the first horn 5.

A second horn 6 is disposed in an extending direction of the cone type vibration plate 4. The second horn 6 is mounted around the first horn 5 such that a gap for extending the first acoustic path 8 is defined between the first horn 5 and the second horn 6. However, such a structure is not indispensable.

A cross-sectional shape of a portion of the first horn 5, which is disposed near the cone type vibration plate 4, is needed to be formed corresponding to a cross-sectional shape of the cone type vibration plate 4. However, the overall cross-sectional shape of the first horn 5 is not restricted to a straight line shape, but may be formed in a curve shape such that a rate of widening is increased as it extends outward. In the same manner, the overall cross-sectional shape of the second horn 6 is not restricted to a straight line shape, but may be formed in a curve shape such that a rate of widening is increased as it extends outward.

It is depicted in the drawing that a hole 7 is formed at a central portion of the diffuser 2, however, the hole 7 is not an indispensable element.

Figure 4:
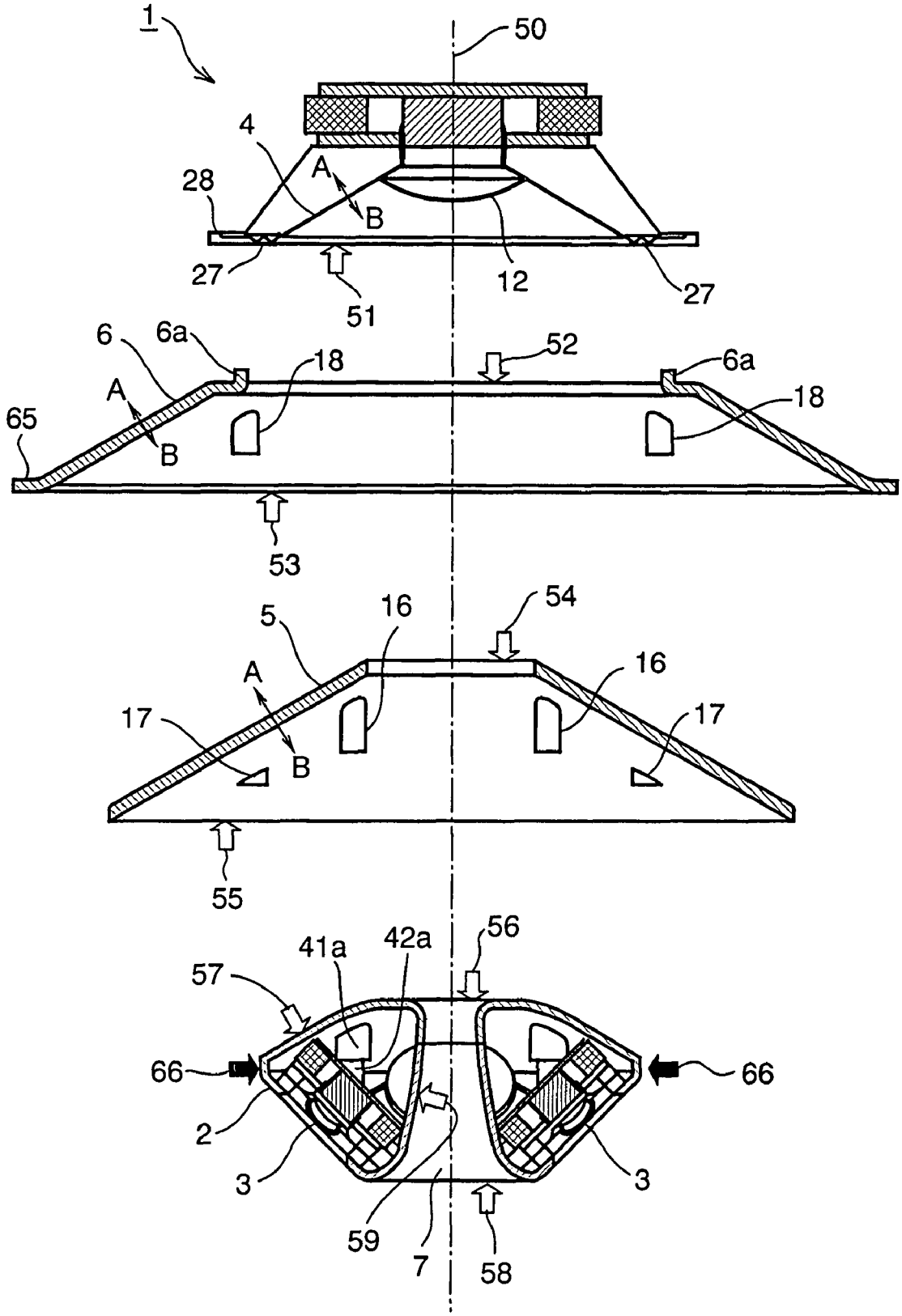
FIG. 4 is an exploded structure view showing a cone type vibration plate, a second horn, a first horn and a diffuser.

A third acoustic path 10 is formed from a center cap 12 at a center of the cone type vibration plate 4 to a front end portion 58 of the diffuser 2 (see FIG. 4).

Because the lengths of the first to third acoustic paths 8, 9 and 10 are different from each other, similarly to the prior art described above, when the sound transferred through the respective acoustic paths is synthesized at a listening position, a mutual interference is generated. At the center position, as the sound frequency is higher, the output sound pressure level is decreased, and the directivity tends to be flattened.

Also, an outer appearance of members for forming the first to third acoustic paths 8, 9 and 10 is formed as round as possible so as to reduce a sound diffraction.

Figure 2:
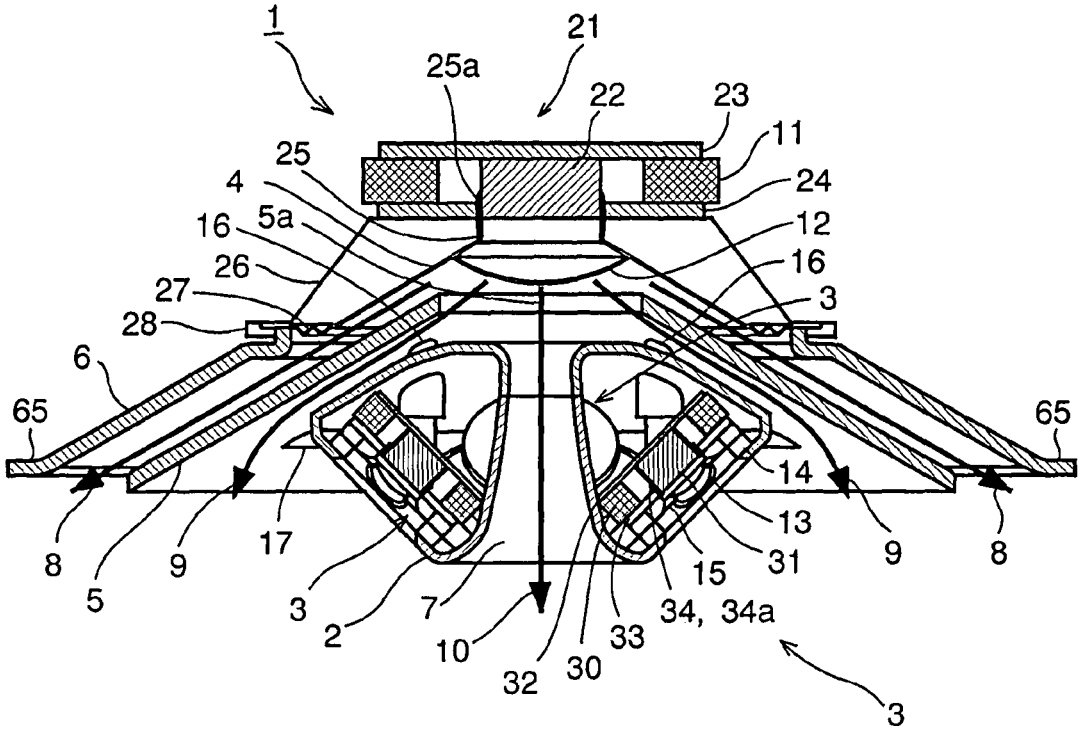
FIG. 2 is a first sectional structure view showing an inner structure of the embodiment depicted in FIG. 1.

FIG. 2 is a first sectional structure view showing an inner structure of an embodiment of the present invention depicted in FIG. 1. This sectional view is a view taken by vertically cutting the speaker system with broad directivity depicted in FIG. 1.

Figure 3:
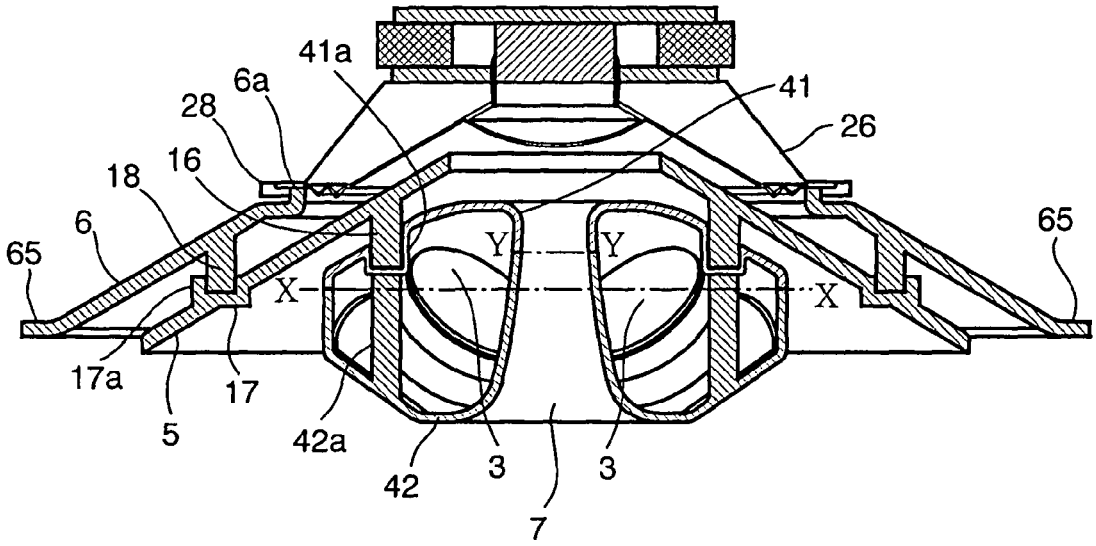
FIG. 3 is a second sectional structure view showing an inner structure of the embodiment depicted in FIG. 1.

Also, FIG. 3 is a second sectional structure view showing an inner structure of the speaker system with broad directivity in accordance with an embodiment of the present invention depicted in FIG. 1. This sectional view is a view taken by cutting the speaker system along an angle in which second screw seats 17 and second self tap bosses 18 are shown. In each drawing, the same elements as FIG. 1 are denoted by the same reference numerals.

Before describing in detail the inner structure, the shapes and arrangement of the cone type vibration plate 4, the first horn 5, the diffuser 2 and the second horn 6 will now be described.

FIG. 4 is an exploded structure view showing the cone type vibration plate 4, the second horn 6, the first horn 5 and the diffuser 2.

FIG. 4 is made based upon the first sectional structure view depicted in FIG. 2, and the same elements as FIGS. 1 and 2 are denoted by the same reference numerals.

A reference numeral 50 is a central axis of the speaker system with broad directivity of the present invention, i.e., a central axis of the cone type speaker unit 1, the second horn 6, the first horn 5 and the diffuser 2.

In the cone type speaker unit 1, "A" is called an outer surface of the cone type vibration plate 4 and "B" is called an inner surface according to whether the surface is located outside the cone type vibration plate 4 or located inside the cone type vibration plate 4. The cone type vibration plate 4 is fixed to a flange 28 at an edge 27. An opening adjacent to the edge 27 of the cone type vibration plate 4 is called a front opening 51.

It is depicted in the drawing that the second horn 6 is a conical horn, however, it may be formed in other shapes such as an exponential horn or the like.

According to whether a surface is located outside the horn or located inside the horn, "A" is called an outer surface of the second horn 6 and "B" is called an inner surface. The second horn 6 is fixed by inserting a protrusion **6*a* into a hole of the flange 28 of the cone type speaker unit 1, which is not illustrated in detail in the drawing. A portion of the second horn 6 coupled to the flange 28 is called a small-diameter opening 52 or rear opening, and a large-diameter portion opposite to the small-diameter opening 52 is called a front opening 53**.

It is depicted in the drawing that the first horn 5 is a conical horn, however, it may be formed in other shapes such as an exponential horn or the like. According to whether a surface is located outside the horn or located inside the horn, "A" is called an outer surface of the first horn 5 and "B" is called an inner surface.

The first horn 5 has four second screw seats 17, which are also shown in FIG. 1, at positions corresponding to the second self tap bosses 18 of the second horn 6. The first horn 5 is fixed to the second horn 6 by tightening self tap screws (not shown) into holes formed at the second self tap bosses 18 from below in the drawing.

An opening of the first horn 5 positioned near the cone type vibration plate 4 is called a small-diameter opening 54 or rear opening, and a large-diameter portion opposite to the small-diameter opening 54 is called a front opening 55.

A central portion of the diffuser 2, which is positioned near the cone type vibration plate 4, is formed in a substantially flat surface, and is called a base portion 56. However, the base portion 56 may be formed in a spherical surface which protrudes toward the cone type vibration plate 4. A portion opposite to the base portion 56 is called a front end portion 58.

Because the curvature of the second acoustic path 9 can be changed by the shape of the diffuser 2, the diffuser 2 has a function as a phase controller capable of adjusting a phase of the sound passing through the second acoustic path 9.

An outer peripheral surface 57 of the diffuser 2 spreads from the base portion 56 along the inner surface of the first horn 5 with a gap from the first horn 5. It is depicted in the drawing that the diffuser 2 is conically formed such that a cross-sectional width is narrowed as it progresses toward the front end portion 58. Considering a cross section of the diffuser 2, because the diffuser is shaped to be tapered or rounded as it progresses toward the front end portion 58, a cross-sectional area becomes smaller.

Accordingly, an inner diameter of a ring-shaped cross section of the second acoustic path 9 is increased from the base portion 56 to an inflection point 66 which is formed between the base portion 56 and the front end portion 58.

As described above, the diffuser 2 has the base portion 56, the front end portion 58 and the outer peripheral surface 57 extending therebetween. The base portion 56 is positioned inward from the front opening 55 of the first horn 5 and opposed to the small-diameter opening 54 of the first horn 5. The diffuser 2 has a specific shape such that the outer peripheral surface 57 of the diffuser 2 expands radially outward from the central axis 50 of the speaker system along the inner surface of the first horn 5 from the base portion 56 to form the second acoustic path 9 between the expanding outer peripheral surface 57 of the diffuser 2 and the inner surface of the first horn 2. The expanding outer peripheral surface 57 of the diffuser 2 reaches the inflection point 66 which is formed between the base portion 56 and the front end portion 58. The outer peripheral surface 57 of the diffuser 2 extends radially inward of the central axis 50 toward the front end portion 58. Stated otherwise, the outer peripheral surface 57 tapers or slants to the edge of the front end portion 58 from the inflection line 66 likewise bezel.

Plural high frequency speakers 3 (e.g., four speakers, as shown in the drawing) are mounted in the outer peripheral surface 57 which is tapered or slanted toward the front end of the diffuser 2. The speaker 3 is accommodated in a space formed in the outer peripheral surface 57 of the diffuser 2. Seen from the central axis 50 of the diffuser 2, the high frequency speakers 3 are arranged or oriented radially outward in oblique directions.

Also, as shown in the drawing, a hole 7 is formed through the central portion of the diffuser 2, and extends from the base portion 56 to the front end portion 58 to form the third acoustic path 10. Accordingly, the front end portion 58 is also a front opening of the hole 7. An inner surface 59 of the hole 7 is rounded at end portions of the base portion 56 and the front end portion 58.

As shown in the drawing, the hole 7 is formed in a horn shape. Overall, the hole 7 has the same shape as the horn in such a manner that a diameter of a cross section of an opening of the base portion 56 is small and a diameter of a cross section of the front opening 58 is large.

However, as long as the hole 7 becomes the acoustic path, the hole 7 is not needed to have a horn shape. The hole 7 may have a cylindrical shape in which the diameter of the opened cross section is constant, or may be configured such that the diameter of the cross section of the front opening is smaller than that of the cross section of the opening of the base portion.

The diffuser 2 is fixed to the first horn 5 by inserting first screw seats 16 of the first horn 5, which are also shown in FIG. 1, into screw seat receiving parts 41*a*, and by tightening self tap screws (not shown) into holes formed at first self tap bosses 42*a* from the first screw seats 16, which will be described in detail later with reference to FIG. 3.

Hereinafter, an arrangement of the components depicted in FIG. 4 and gaps for forming the first to three acoustic paths depicted in FIGS. 1 and 2 will be described.

The small-diameter opening 54 of the first horn 5 is positioned inward from the front opening 51 of the cone type vibration plate 4. The outer surface A of the first horn 5 is arranged along the inner surface B of the cone type vibration plate 4 from the small-diameter opening 54 of the first horn 5, so as to form the first acoustic path 8 (see FIGS. 1 and 2) therebetween. Accordingly, at least one portion of the first horn 5 is located inside (the inner surface B side) the cone type vibration plate 4.

On the other hand, the second horn 6 is located adjacent to the front opening 51 of the cone type vibration plate 4, and expands in an extending direction of the cone type vibration plate 4. The inner surface B of the second horn 6 is arranged along the outer surface A of the first horn 5, so as to form the gap therebetween for extending the first acoustic path 8 (see FIGS. 1 and 2).

It is depicted in the drawing that the front opening 55 of the first horn 5 protrudes forward from the front opening 53 of the second horn 6, however, this is not restricted thereto. Because the second horn 6 is provided for extending the first acoustic path 8 and concentrating the sound on the central area, the front opening 55 of the first horn 5 may be positioned inward from the front opening 53 of the second horn 6.

The base portion 56 of the diffuser 2 is positioned inward from the front opening 55 of the first horn 5, and opposed to the small-diameter opening 54 of the first horn 5. The outer peripheral surface 57 of the diffuser 2 is arranged along the inner surface B of the first horn 5 from the base portion 56, so as to form the second acoustic path 9 (see FIGS. 1 and 2).

As shown in the drawing, the front end portion 58 of the diffuser 2 protrudes forward from the front opening 55 of the first horn 5. However, because the diffuser 2 is for forming the second acoustic path in the oblique direction, the protrusion of the front end portion 58 of the diffuser 2 is not an essential structure.

Four high frequency speakers 3 are receivedly mounted in the outer peripheral surface 57 which is slantedly cut around the front end portion 58 of the diffuser 2. Seen from the central axis 50 of the diffuser 2, the high frequency speakers 3 are arranged radially (outward-looking) and equi-angularly with each other (see FIG. 1).

The diffuser 2 has the hole 7 at the central portion, which forms the third acoustic path 10 (see FIGS. 1 and 2).

Referring again to FIGS. 1 to 3, an inner structure of the cone type speaker unit 1 will be described. The basic structure is similar to that of the prior art.

As shown in FIG. 2, the cone type speaker unit 1 is an electrodynamic speaker.

The cone type speaker unit 1 is fixed by attaching the flange 28 to a planar baffle plate of a ceiling (not shown) or holes formed at an enclosure of a speaker box (not shown) by use of screws. In case that the flange 65 is formed around the front opening 53 of the second horn 6, as shown in the drawing, the cone type speaker unit 1 may be fixed by attaching the flange 65 of the second horn 6 to the planar baffle plate of the ceiling or the holes formed at the enclosure of the speaker box.

A magnetic circuit unit 21 depicted in FIG. 2 is an outer magnetic type. A center pole 22 is provided at the center of a ring-shaped magnet 11. The magnet 11 is interposed between the yoke 23 and the plate 24, and the center pole 22 is inserted into a center hole of the plate 24. These components constitute the magnetic circuit unit 21.

A ring-shaped gap is formed between the center hole of the plate 24 and the center pole 22, and a voice coil 25*a* which is wound around a voice coil bobbin 25 is disposed in the ring-shaped gap. The voice coil bobbin 25 is fixedly mounted to the cone type vibration plate 4. A reference numeral 12 means a center cap. By applying an electric signal of a voice frequency to the voice coil 25*a*, the cone type vibration plate 4 is driven.

The magnetic circuit unit 21 is coupled to the flange 28 by a hollow frame 26.

The front opening 51 (see FIG. 4) of the cone type vibration plate 4 is fixed to the flange 28 by the edge 27.

As long as the frame 26 having the flange 28 is used only for fixing the magnetic circuit unit 21 and the cone type vibration plate 4, the frame 26 is not limited to any particular shape. For example, the frame 26 may be formed in a porous conical shape, a n-prismoidal shape (n is 3, 4, 5, . . . ) or the like.

When the cone type vibration plate 4 of the cone type speaker unit 1 is driven by the electric signal applied to the voice coil 25*a*, the sound is emitted by being trifurcated through the different paths, i.e., the first to third acoustic paths 8, 9 and 10.

When the cone type speaker unit 1 emits the low frequency sound, the whole of the cone type vibration plate 4 performs the piston movement. Therefore, path difference is not generated between the first to third acoustic paths 8, 9 and 10.

But, when the cone type speaker unit 1 emits the high frequency sound, the cone type vibration plate 4 generates a divisional vibration. The cone type vibration plate 4 vibrates only near the center. Accordingly, the sound energy is concentrated near the center of the cone type vibration plate 4, and the cone type vibration plate 4 becomes like a point sound source.

Accordingly, when the sound passes through the first acoustic path 8, the second acoustic path 9 and the third acoustic path 10, because the path difference is generated at the front of the speaker system (near the central axis), in case of the high frequency sound, i.e., the short-wavelength, a phase interference for wave offset is generated. Thus, a "degree of summation of the sound pressure" of the sound passing through the respective acoustic paths gets worse, but the "degree of summation of the sound pressure" in the oblique direction gets better. As a result, the directivity can be broadened.

As such, because the embodiment of the present invention does not confine the sound within the cone type vibration plate 4, like the prior art, the output sound pressure level of high frequency is not suppressed.

Also, it is possible to design the shape of the diffuser 2 such that the sound pressure in the oblique direction is higher than the sound pressure at the front of the diffuser 2.

Although it is depicted in the drawing that the second horn 6 is mounted, the second horn 6 is not an essential element from a point of view that the second horn 6 is an element only for concentrating the sound emitted through the first acoustic path 8 on the central area.

Also, the hole 7 formed at the diffuser 2 forms the third acoustic path. By increasing the acoustic paths, a peak and a dip generated at a specific frequency can be moderated by the phase interference. However, the hole 7 is not an essential element.

As shown in FIG. 2, the high frequency speaker units 3 are a kind of small dome type tweeter, e.g., a well-known balance dome tweeter. A phase plug 13 is mounted to a supporting part 14 by a spoke 13*a* (see FIG. 1). The phase plug 13 is an element for providing a sound load to prevent the phase interference.

In FIG. 2, a reference numeral 15 means a vibration plate and edge, a central portion of which is the vibration plate having a dome (hemispheric) shape, and a circumferential portion of which is the edge having a semi-annular (semi-doughnut) shape. An area of the edge is substantially same as that of the vibration plate.

A magnetic circuit unit 30, 31, 32 and 33 is an outer magnetic type, and a center pole 31 is provided in a center of a ring-shaped magnet 30. The magnet 30 is interposed between a yoke 32 and a plate 33. A ring-shaped gap is formed between a center hole of the plate 33 and the center pole 31, and a voice coil 34*a* which is wound around a voice coil bobbin 34 is disposed in the ring-shaped gap. The voice coil bobbin 34 is fixed to a boundary between the vibration plate and the edge. The "vibration and edge" 15 and the plate 33 are mounted to the diffuser 2 by the supporting part 15.

Also, the high frequency speaker units 3 are not an essential element from a point of view that the high frequency speaker units 3 are only for making the speaker system with broad directivity of the full-range speaker system.

Referring to FIG. 3, the structure of coupling the first horn 5 to the second horn 6 and the structure of coupling the diffuser 2 to the first horn 5 will be described.

The second screw seats 17 are formed at the first horn 5, and coupling parts 17*a* are formed at the second screw seats 17 on the outer surface A (see FIG. 4) of the first horn 5. The second self tap bosses 18 of the second horn 6 are inserted into the coupling parts 17*a*, and the self tap screws are tightened into the second self tap bosses 18 from the second screw seats 17.

The diffuser 2 includes diffuser assemblies 41 and 42 which are assembled along a line X-X at the outer peripheral surface 57 (see FIG. 4) and along a line Y-Y at the inner surface 59 (see FIG. 4).

The screw seat receiving parts 41*a* of the diffuser assembly 41 are aligned with the first self tap bosses 42*a* of the diffuser assembly 42, and the first screw seats 16 protruding from the inner surface B of the first horn 5 (see FIG. 4) are inserted into the screw seat receiving parts 41*a*. The self tap screws are tightened into the first self tap bosses 42*a* through the first screw seats 16 and the screw seat receiving parts 41*a* from the outer surface A of the first horn 5. As a result, the diffuser assembly 41 and the diffuser assembly 42 are integrally coupled, and fixed to the first horn 5.

Figure 5:
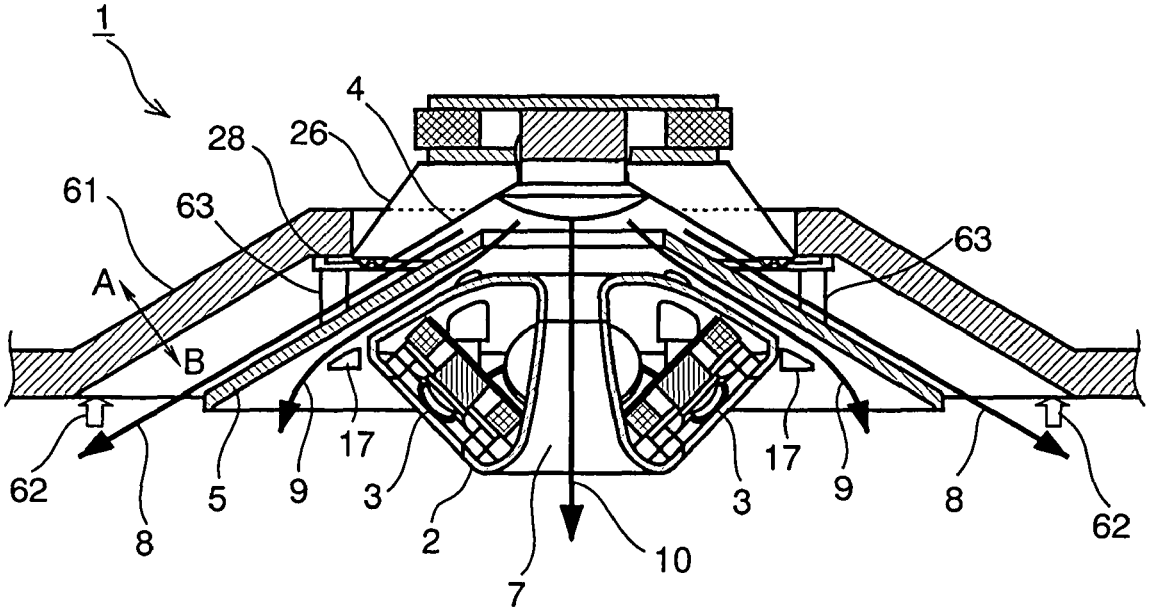
FIG. 5 is a sectional structure view showing a second embodiment of present invention.

FIG. 5 is a sectional structure view showing a second embodiment of present invention.

In the drawing, the same elements as FIGS. 1 to 4 are denoted by the same reference numerals, and detailed description thereof will be omitted.

In this embodiment, the flange 28 of the cone type speaker unit 1 is mounted to a horn-shaped baffle plate 61. The horn-shaped baffle plate 61 has a conical horn shape. It is preferable that an inner surface B of the horn-shaped baffle plate 61 expands along the outer surface A of the first horn 5 (see FIG. 4).

Functionally, the horn-shaped baffle plate 61 can substitute for the second horn 6 described with reference to FIGS. 1 to 4. In addition, the horn-shaped baffle plate 61 has a function as a baffle for preventing the sound emitted from the outer surface A of the cone type vibration plate 4 (see FIG. 4) from turning back to the front surface.

A reference numeral 63 is a self tap boss, which is previously fixed to the flange 28 by a predetermined fixing method. The first horn 5 is fixed to the flange 28 of the cone type speaker unit 1, for example, by tightening the self tap screws (not shown) into the self tap boss 63 from the second screw seat 17.

Figure 6:
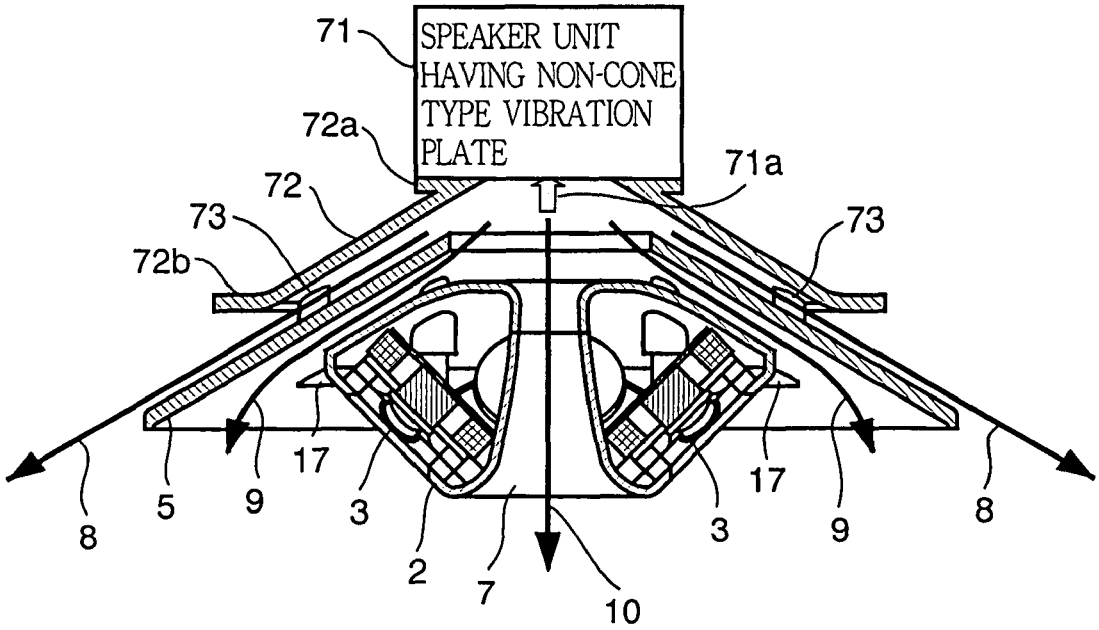
FIG. 6 is a sectional structure view showing a third embodiment of present invention.
Figure 7:
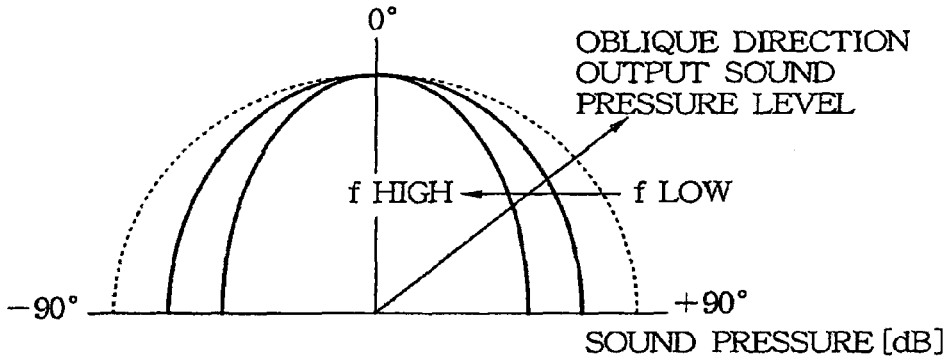
FIGS. 7(*a*) and 7(*b*) are graphs showing features of a conventional cone type speaker with large diameter.
Figure 7:
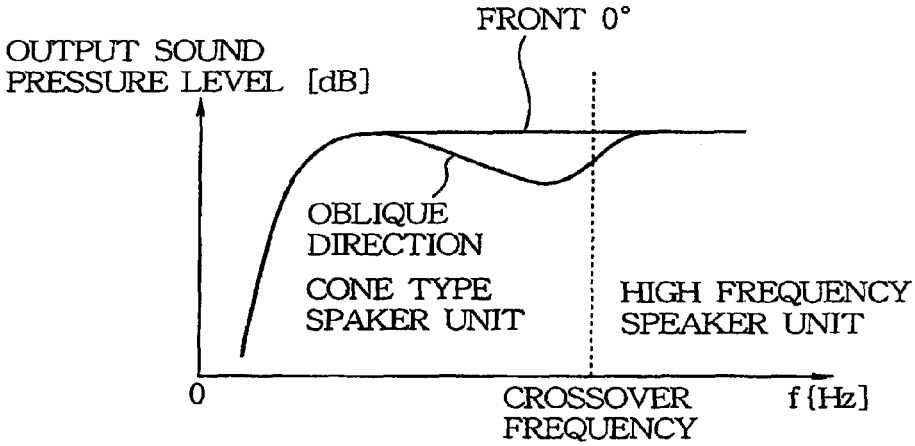

FIG. 6 is a sectional structure view showing a third embodiment of present invention. In the drawing, the same elements as FIGS. 1 to 5 are denoted by the same reference numerals, and detailed description thereof will be omitted.

In this embodiment, instead of the cone type speaker unit 1 depicted in FIGS. 1 to 5, a speaker unit 71 having a non-cone type vibration plate is used. The non-cone type vibration plate is also driven by the voice coil of the magnetic circuit unit.

A speaker unit having a dome type vibration plate, a speaker unit having a plane type vibration plate or the like can be used as the speaker unit 71 having the non-cone type vibration plate.

In this embodiment, a second horn 72 substitutes for the cone type vibration plate 4 depicted in FIGS. 1 to 4. The second horn 72 is configured as if the small-diameter opening 52 (see FIG. 4) of the second horn 6 depicted in FIGS. 1 to 4 is extended to an opening 71*a* of the speaker unit 71 and mounted to the speaker unit 71 having the non-cone type vibration plate.

Accordingly, a small-diameter opening formed at a first flange 72*a* of the second horn 72 is positioned at the opening 71*a* of the speaker unit 71 having the non-cone type vibration plate. The second horn 72 is formed with a second flange 72*b* for being mounted to a baffle plate (not shown).

The small-diameter opening 54 of the first horn 5 (see FIG. 4) is positioned inward from a front opening of the second horn 72 (which corresponds to the front opening 53 in FIG. 4).

An outer surface of the first horn 5 (which corresponds to the outer surface A of the second horn 6 in FIG. 4) extends along an inner surface of the second horn 72 (which corresponds to the inner surface B of the second horn 6 in FIG. 4) from the small-diameter opening so as to form the first acoustic path 8.

Since the diffuser 2 is same as that depicted in FIGS. 1 to 4, the description thereof is omitted.

If it is needed to make the speaker system with broad directivity of the full-range speaker system, the high frequency speakers 3 are installed. However, if not, the high frequency speakers 3 are not necessarily installed.

Instead of the cone type vibration plate 4 depicted in FIGS. 1 to 4, the second horn 72 is provided. Therefore, although the speaker unit 71 having the non-cone type vibration plate is used, the speaker system of this embodiment can achieve the broad directivity from the low frequency range to the relatively high frequency range, identically to the previous embodiment described with reference to FIGS. 1 to 4.

It is depicted in the drawing that the front opening 55 of the first horn 5 (see FIG. 4) protrudes forward from the front opening of the second horn 72, however, this is not an indispensable structure.

Although a plane wave is radiated from the opening 71*a* of the speaker unit 71 having the non-cone type vibration plate, the second horn 72 transforms the plane wave into a spherical wave, and becomes like a point sound source which expands from the center. Accordingly, the phase interference is generated, like the speaker system using the cone type speaker 1, and the output sound pressure level at the center portion is decreased. Thus, the speaker system can achieve the broad directivity ranging from the low frequency to the relatively high frequency. It is possible to design the shape of the diffuser 2 such that the sound pressure in the oblique direction is higher than the sound pressure at the front of the diffuser 2.

It is possible to use the speaker unit which is equipped with a ribbon type vibration plate (the vibration plate is also a conductor for transmitting an electric signal) as the speaker unit 71 having the non-cone type vibration plate. In case of the ribbon type vibration plate, because the vibration plate has a rectangular shape, it is not rotationally symmetric. Thus, it is necessary to modify the shapes of the first horn 5, the second horn and the diffuser 2 adequately for a symmetric axis of the vibration plate.

The cone type speaker unit 1 is an electrodynamic speaker, however, it is not restricted thereto, but may have other driving process using an electromagnetic force. Also, a piezoelectric speaker or an electrostatic (condenser) speaker may be used.

Also, the cone type vibration plate 4 has the edge 27, however, the cone type vibration plate 4 may not have the edge.

Also, the present invention is not applied only to the speaker system which is mounted to the ceiling, but also to other types of the speaker system, e.g., a box type speaker system.

The invention claimed is:

1. A speaker system with broad directivity using a speaker unit having a cone type vibration plate with a front opening, the speaker system comprising:

a first horn;

a diffuser; and a plurality of high frequency speakers, wherein the first horn has a small-diameter opening and is disposed such that the small-diameter opening is positioned inward from the front opening of the cone type vibration plate and an outer surface of the first horn is arranged along an inner surface of the cone type vibration plate from the small-diameter opening to form a first acoustic path between the outer surface of the first horn and the inner surface of the cone type vibration plate, wherein the diffuser has a base portion, a front end portion opposite the base portion and an outer peripheral surface extending therebetween, and is disposed such that the base portion is positioned inward from a front opening of the first horn and opposite the small-diameter opening of the first horn, and the diffuser has a shape such that the outer peripheral surface of the diffuser expands along an inner surface of the first horn from the base portion to form a second acoustic path between the expanding outer peripheral surface of the diffuser and the inner surface of the first horn and such that the outer peripheral surface of the diffuser is then narrowed toward the front end portion of the diffuser so that a cross-sectional area of the diffuser narrows toward the front end portion of the diffuser, and wherein the plurality of high frequency speakers are accommodated in the outer peripheral surface of the diffuser which is obliquely cut around the front end of the diffuser such that the plurality of high frequency speakers are arranged radially around a central axis of the diffuser.

2. The speaker system with broad directivity according to claim 1, further comprising a second horn that is located adjacent to the front opening of the cone type vibration plate and expands in an extending direction of the cone type vibration plate, and that is disposed such that an inner surface of the second horn is arranged along the outer surface of the first horn to form a gap between the inner surface of the second horn and the outer surface of the first horn for extending the first acoustic path.

3. The speaker system with broad directivity according to claim 1, wherein the diffuser has a hole at a central portion thereof which forms a third acoustic path.

4. A speaker system with broad directivity using a speaker unit having a vibration plate, the speaker system comprising:

a first horn;

a second horn;

a diffuser; and a plurality of high frequency speakers, wherein the second horn is disposed such that a small-diameter opening of the second horn is positioned at an opening of the speaker unit, wherein the first horn is disposed such that a small-diameter opening of the first horn is positioned inward from a front opening of the second horn and that an outer surface of the first horn extends along an inner surface of the second horn from the small-diameter opening of the first horn to form a first acoustic path between the outer surface of the first horn and the inner surface of the second horn, wherein the diffuser has a base portion, a front end portion opposite the base portion and an outer peripheral surface extending therebetween, and is disposed such that the base portion is positioned inward from a front opening of the first horn and opposite the small-diameter opening of the first horn, and the diffuser has a shape such that the outer peripheral surface of the diffuser expands along an inner surface of the first horn from the base portion to form a second acoustic path between the expanding outer peripheral surface of the diffuser and the inner surface of the first horn and such that the outer peripheral surface of the diffuser is then narrowed toward the front end portion of the diffuser so that a cross-sectional area of the diffuser narrows toward the front end portion of the diffuser, and wherein the plurality of high frequency speakers are accommodated in the outer peripheral surface of the diffuser which is obliquely cut around the front end of the diffuser such that the plurality of high frequency speakers are arranged radially around a central axis of the diffuser.

5. The speaker system with broad directivity according to claim 4, wherein the diffuser has a hole at a central portion thereof which forms a third acoustic path.

6. The speaker system with broad directivity according to claim 4, wherein the speaker unit has the vibration plate of a non-cone type.

* * * * *